US009762991B2

(12) United States Patent
Yang

(10) Patent No.: US 9,762,991 B2
(45) Date of Patent: Sep. 12, 2017

(54) PASSIVE NOISE-CANCELLATION OF AN IN-EAR HEADSET MODULE

(71) Applicant: Bill Yang, Taipei (TW)

(72) Inventor: Bill Yang, Taipei (TW)

(73) Assignee: Cotron Corporation, Taipei (TW)

( * ) Notice: Subject to any disclaimer, the term of this patent is extended or adjusted under 35 U.S.C. 154(b) by 0 days.

(21) Appl. No.: 15/132,235

(22) Filed: Apr. 18, 2016

(65) Prior Publication Data

US 2017/0048608 A1 Feb. 16, 2017

(30) Foreign Application Priority Data

Aug. 10, 2015 (TW) ..... 104125903 A
Mar. 4, 2016 (TW) ..... 105106654 A

(51) Int. Cl.
*H04R 1/10* (2006.01)
*H04R 19/04* (2006.01)

(52) U.S. Cl.
CPC ..... *H04R 1/1083* (2013.01); *H04R 1/1016* (2013.01); *H04R 19/04* (2013.01); *H04R 2420/07* (2013.01); *H04R 2460/01* (2013.01)

(58) Field of Classification Search
CPC ..... H04R 2225/021; H04R 2225/023; H04R 25/652; H04R 1/1016; H04R 25/604; H04R 1/1066; H04R 1/1008; H04R 2420/07; H04R 25/608; H04R 1/1083; H04R 1/1091; H04R 2225/63; H04R 2460/01
See application file for complete search history.

(56) References Cited

U.S. PATENT DOCUMENTS 8,213,645 B2 * 7/2012 Rye ..... H04M 1/05 381/151
8,295,503 B2 * 10/2012 Sung ..... G10K 11/1788 381/71.1
8,781,141 B2 * 7/2014 Higgins ..... H04R 25/556 381/312
2009/0209304 A1 * 8/2009 Ngia ..... H04R 1/1091 455/575.2
2010/0246860 A1 9/2010 Rye et al.
2012/0087532 A1 * 4/2012 Yang ..... H04R 1/10 381/380
2014/0301591 A1 * 10/2014 Yang ..... H04R 1/1016 381/380
2015/0023541 A1 * 1/2015 Ho ..... H04R 1/1016 381/380

(Continued)

FOREIGN PATENT DOCUMENTS

CN 101272638 9/2008

OTHER PUBLICATIONS

"Office Action of Taiwan Counterpart Application", dated Oct. 18, 2016, p. 1-p. 6.

*Primary Examiner* — Mohammad Islam
(74) *Attorney, Agent, or Firm* — Jianq Chyun IP Office

(57) ABSTRACT

An in-ear headset module including a housing, an earpad, a speaker unit and a microphone is provided. The housing has a chamber and an audio outlet communicated with the chamber. The earpad is disposed outside the housing. The speaker unit and the microphone are disposed in the chamber, and the microphone is located between the speaker unit and the audio outlet. The diameter of the microphone is smaller than or equal to 6 mm.

15 Claims, 3 Drawing Sheets

(56) References Cited

U.S. PATENT DOCUMENTS

| | | | | |
|---|---|---|---|---|
| 2015/0110329 | A1* | 4/2015 | Tanaka | H04R 1/1016 381/380 |
| 2015/0237437 | A1* | 8/2015 | Hu | H04R 1/1058 381/338 |
| 2016/0014493 | A1* | 1/2016 | Chen | H04R 1/1016 381/338 |
| 2016/0210956 | A1* | 7/2016 | Huang | G10K 11/1782 |
| 2016/0212521 | A1* | 7/2016 | Huang | H04R 1/1008 |
| 2016/0219384 | A1* | 7/2016 | Petersen | H04R 25/654 |
| 2017/0006371 | A1* | 1/2017 | Lam | H04R 1/1016 |

* cited by examiner

PASSIVE NOISE-CANCELLATION OF AN IN-EAR HEADSET MODULE

CROSS-REFERENCE TO RELATED APPLICATION

This application claims the priority benefit of Taiwan application serial no. 104125903, filed on Aug. 10, 2015, and Taiwan application serial no. 105106654, filed on Mar. 4, 2016. The entirety of each of the above-mentioned patent applications is hereby incorporated by reference herein and made a part of this specification.

BACKGROUND OF THE INVENTION

Field of the Invention

The invention relates to an in-ear headset module, more specifically relates to a passive noise-cancelling in-ear headset module.

Description of Related Art

Along with the continuous improvement of technology, all of electronic products have been developed with a tendency to become lighter and more miniaturized, and the electronic products like smartphone, tablet computer, or notebook, etc., have become indispensable in daily life of human beings. For each of those aforementioned electronic products, in order to allow a user/listener to listen to the audio information provided by the electronic product without disturbing the other people around, an earphone has become a necessary accessory to the electronic product. Moreover, the earphone also provides a better audio transmission to the listener so that the listener can clearly hear and understand the content of the audio information, and especially, unlike the an unclear audio transmission through the air, the audio transmission of the earphone is not be affected while the listener is moving, such as exercising, driving, engaging in intense movements or being in a noisy environment. Otherwise, in order to make a phone call by using the electronic products, a headset having a microphone is also a popular accessory.

In order to perform both audio listening and sound collecting functions, a conventional headset adopts a design having an earphone and a microphone separated from each other, the earphone and the microphone are connected to each other via a signal wire or a simple structure. Therefore, the earphone is close to the ear, and the microphone is close to the mouth. However, the microphone in the above-mentioned design also receives the environmental noise, so the distinctness of the voice of the user is greatly affected. If an active noise-cancelling method is adopted, a noise-cancelling circuit needs being installed so as to increase cost, and the fidelity of the collected sound is also damaged when using the active noise-cancelling method. Otherwise, in order to decrease the volume of the headset, another conventional headset adopts Bluetooth communication, and the earphone and the microphone are disposed inside the same casing. However, like the old design, the microphone of this design is located at an end closest to the mouth, and the distance between the microphone and the mouth becomes longer, so a more expensive directional microphone needs to be adopted to receive sound.

SUMMARY OF THE INVENTION

The invention provides an in-ear headset module capable of solving problems in conventional technology that the microphone receiving sound effect is not good and noise-cancelling cost is high.

The in-ear headset module of the invention includes a housing, a speaker unit, an earpad, and a microphone. The housing has a chamber and an audio outlet communicated with the chamber. The earpad is disposed outside the housing. The speaker unit and the microphone are disposed in the chamber, and the microphone is disposed between the audio outlet and the speaker unit. The diameter of the microphone is smaller than or equal to 6 mm.

In one embodiment of the invention, the speaker unit separates the chamber into a front chamber and a rear chamber and prevents air from flowing between the front chamber and the rear chamber, and the microphone is located in the front chamber.

In one embodiment of the invention, the in-ear headset module further includes a moisture-proof air-permeable element disposed at the audio outlet.

In one embodiment of the invention, a moisture-proof air-permeable element is disposed at an audio inlet of the microphone.

In one embodiment of the invention, the earpad is disposed outside the audio outlet of the housing and forms a channel communicated with the audio outlet. The size of the channel is maintained constant or increased from an end close to the audio outlet to an end far from the audio outlet.

In one embodiment of the present invention, the microphone is a condenser microphone.

In one embodiment of the present invention, a channel is formed between the microphone and the wall of the chamber and configured to transmit sound provided from the speaker unit through the channel to outside the audio outlet.

In one embodiment of the invention, the in-ear headset module further includes a Bluetooth communication unit electrically connecting to the speaker unit and the microphone. The Bluetooth communication unit has an echo cancelling circuit.

In one embodiment of the invention, the in-ear headset module further includes a Bluetooth communication unit electrically connecting to speaker unit and the microphone. The Bluetooth communication unit has a microphone high pass filter circuit, and a cutoff frequency of the microphone high pass filter circuit is greater than or equal to 300 Hz.

In one embodiment of the invention, the in-ear headset module further includes a Bluetooth communication unit electrically connecting to speaker unit and the microphone. The Bluetooth communication unit has a microphone high pass filter circuit, and a slope of the microphone high pass filter circuit is greater than or equal to 3 dB/octave.

In one embodiment of the invention, the housing is integrally formed, the maximum outer diameter of the housing is smaller than or equal to 8 mm.

In one embodiment of the invention, the diameter of the speaker unit is smaller than or equal to 6 mm.

In one embodiment of the invention, an audio inlet of the microphone is directly opposite the audio outlet.

In one embodiment of the invention, the in-ear headset module further includes a printed circuit board. The printed circuit board is engaged in the chamber. The microphone is soldered on the printed circuit board. A channel is formed between the printed circuit board and the wall of the chamber and configured to transmit sound provided from the speaker unit through the channel to outside the audio outlet.

In one embodiment of the invention, the in-ear headset module further includes a microphone lead wire. A wire slot is formed on the wall of the chamber. The microphone lead wire electrically connects with the microphone and extends through the wire slot to outside.

Based on the above, in the in-ear headset module of the invention, both the speaker unit and the earpad provide an airtight noise-cancelling function. Therefore, the in-ear headset module of the invention may isolate the noise of the environment so as to achieve a better sound receiving effect.

In order to make the aforementioned and other features and advantages of the invention more comprehensible, embodiments accompanying figures are described in detail belows.

DESCRIPTION OF THE EMBODIMENTS

Figure 1:
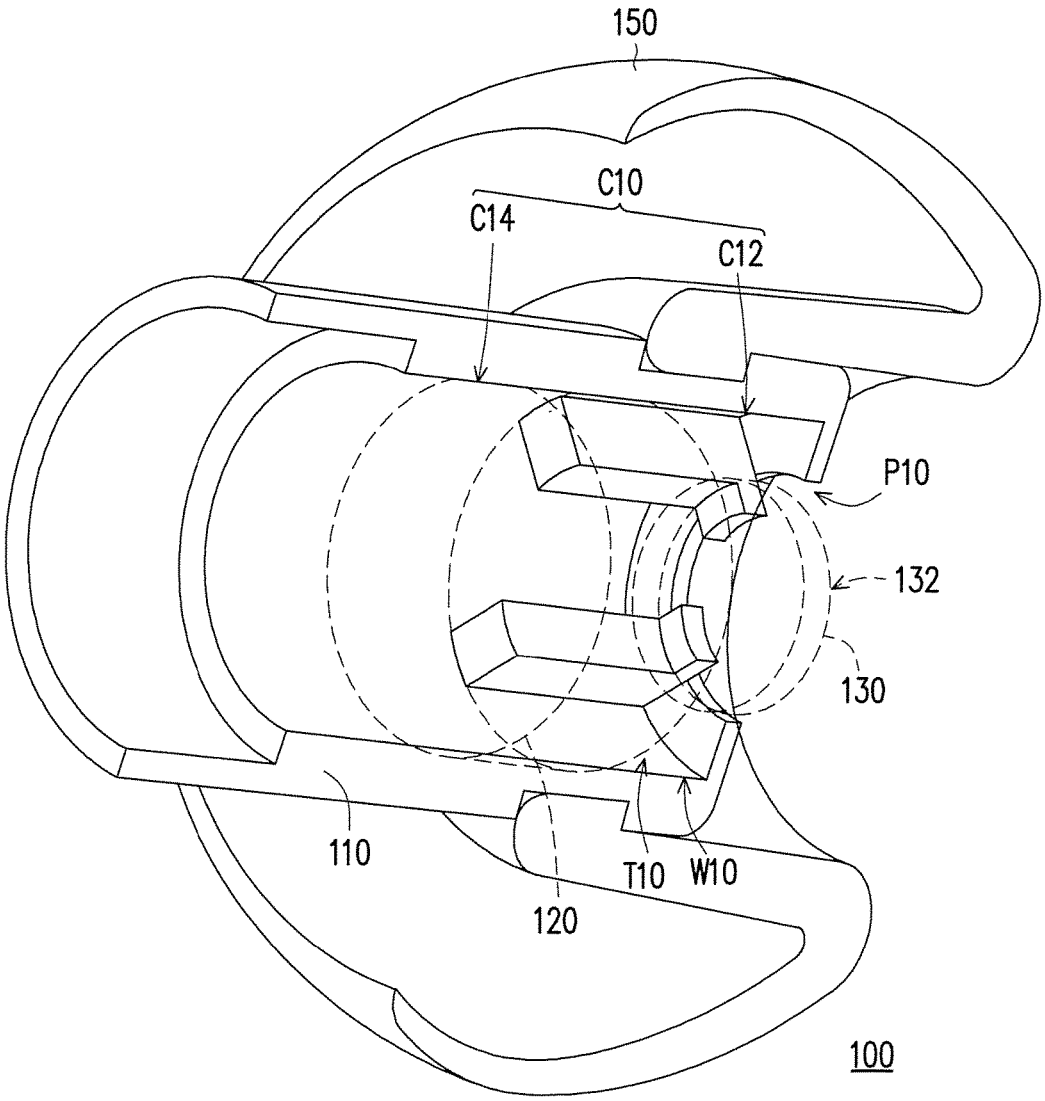
FIG. 1 is a partial cross-sectional view of an in-ear headset module according to one embodiment of the invention.

FIG. 1 is a partial cross-sectional view of an in-ear headset module according to one embodiment of the invention. Referring to FIG. 1, an in-ear headset module 100 of the present embodiment includes a housing 110, an earpad 150, a speaker unit 120, and a microphone 130. The housing 110 has a chamber C10 and an audio outlet P10. The chamber C10 is communicated with the audio outlet P10. The earpad 150 is disposed outside the housing 110. Both the speaker unit 120 and the microphone 130 are disposed in the chamber C10, and the microphone 130 is disposed between the audio outlet P10 and the speaker unit 120. The diameter of the microphone 130 is smaller than or equal to 6 mm, so the microphone 130 together with the housing 110 can be inserted into the ear canal of the user to be close to the eardrum. The reason why the in-ear headset module 100 of the present embodiment is called "in ear" is that a partial volume of the headset module 100 may be placed into the ear canal from the auricle (the external ear), and the dead end of the ear canal is the eardrum. The average diameter of the ear canal of human is greater than 8 mm, and the diameter of the microphone 130 in the present embodiment is smaller than or equal to 6 mm, so the microphone 130 may be inserted into the ear canal and approaches the eardrum to detect sound waves transmitted in the ear canal. When the in-ear headset module 100 is wore on the ear of the user and is inserted into the ear canal, the audio outlet P10 faces and approaches the eardrum of the ear, and the speaker unit 120 and the earpad 150 prevent the environmental noise being transmitted to the microphone 130, so as to produce a passive noise-cancelling effect and to increase the fidelity of the collected sound also. To be more specific, the speaker unit 120 prevents the environmental noise being transmitted from inside the housing 110 to the microphone 130, and the earpad 150 prevents the environmental noise being transmitted from outside the housing 110 to the microphone 130. In addition, since the microphone 130 is very close to the eardrum of the user, the sound wave produced by eardrum vibration formed when the user speaks is sensitively detected and collected by the microphone 130, and the sound produced by the user may be well transmitted to inside the ear canal by human bone and may be collected by the microphone 130.

Because a part of the in-ear headset module 100 is placed into the ear canal and in contact with the skin so as to be affected by the temperature (36° C.), and the exposed part of the in-ear headset module 100 is affected by the environment. Generally, when the environmental temperature is near 0° C., because of the effect of temperature difference, the condensation from gas phase into liquid phase is easily formed, so the electrostatic microphone is seriously affected such that the sensitivity of the microphone is greatly decreased.

In the present embodiment, the speaker unit 120 separates the chamber C10 into a front chamber C12 and a rear chamber C14 and prevents air from flowing between the front chamber C12 and the rear chamber C14, and the microphone 130 is located in the front chamber C12. In other words, the contact between the speaker unit 120 and the chamber C10 is essentially an airtight contact, so it is unable to transmit the air from the rear chamber C14 to the front chamber C12, so as to reduce the probability that the environmental noise is collected by the microphone 130. The maximum outer diameter of the housing 110 is, for example, smaller than or equal to 8 mm, so as to be conveniently placed in the ear canal of the user when the in-ear headset module is wore. The diameter of the speaker unit 120 in the present embodiment is, for example, smaller than or equal to 6 mm and the speaker unit 120 is disposed as close to the microphone 130 as possible in order to reduce an enclosed space formed between the ear canal and the in-ear headset module 100 and then to increase the sensitivity of the speaker unit 120 and the microphone 130. The microphone 130 may be a condenser microphone or other types of microphones, the appearance of the microphone 130 may be designed as a round shape or other appearances. An audio inlet 132 of the microphone 130 is directly opposite the audio outlet P10, thus the audio inlet 132 of the microphone 130 may be seen from the audio outlet P10, so as to achieve a better sound receiving effect.

In the present embodiment, a channel T10 is formed between the microphone 130 and a wall W10 of the chamber C10 and configured to transmit sound provided from the speaker unit 120 through the channel T10 to outside the audio outlet P10. Therefore, the sound provided from the speaker unit 120 may be well transmitted to the eardrum. In addition, the housing 110 of the present embodiment is integrally formed, so the entire structure is simple and is easily assembled. The in-ear headset module 100 of the present embodiment may adopt monaural or binaural designs. When the binaural design is adopted, the microphone 130 is only configured at one side, and a virtual microphone is configured at another side, so as to make the sound field of both sides identical. The shape of the virtual microphone is the same as the shape of the microphone 130, but the virtual microphone does not have sound receiving function.

Figure 2:
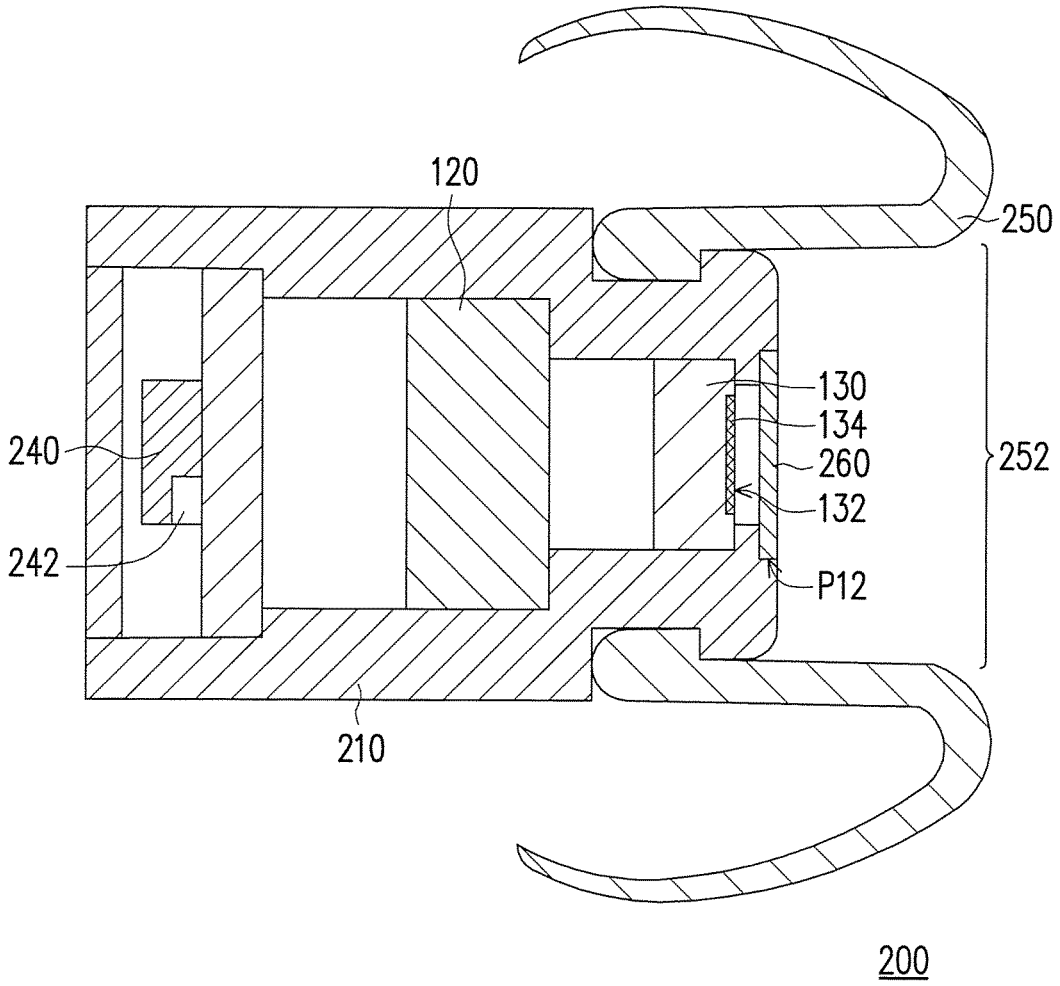
FIG. 2 is a cross-sectional schematic view of an in-ear headset module according to another embodiment of the invention.

FIG. 2 is a cross-sectional schematic view of an in-ear headset module according to another embodiment of the invention. Referring to FIG. 2, the in-ear headset module 200 of the present embodiment is similar to the in-ear headset module 100 in FIG. 1, only the differences between two modules are introduced herein. The in-ear headset module 200 of the present embodiment further includes a Bluetooth communication unit 240 electrically connecting to the speaker unit 120 and the microphone 130. The electrical connection between the Bluetooth communication unit 240 and both the speaker unit 120 and the microphone 130 may be achieved via conducting wire and circuit board, which are omitted and not shown in FIG. 2. Via the Bluetooth communication unit 240, the in-ear headset module 200 of the present embodiment transmits and receives the sound signal from an electronic device by Bluetooth communication. Simultaneously, the Bluetooth communication unit 240 has an echo cancelling circuit, so the audio signal emitted from the microphone 130 only includes the audio signal recorded from the speaker-end, such as the sound produced by the user, and does not mix with the sound of the receiver-end produced by the speaker unit 120. Certainly, the in-ear headset module of the invention may also adopt wired method to transmit the audio signal to and collect the audio signal from an electronic device. This electronic device may have the aforementioned echo cancelling function. Moreover, a battery may be disposed inside the in-ear headset module 200, but the battery is omitted and not shown in FIG. 2. The entire in-ear headset module 200 may be almost placed inside the ear canal, not only does the appearance become more beautiful, but also the load on the ear of the user is reduced. Otherwise, an earpad 250 may be assembled outside the housing 210 of the in-ear headset module 200. The earpad 250 of the present embodiment sleeves an end having the audio outlet P10 of the housing 110, and the audio outlet P10 is located inside the earpad 250. The earpad 250 forms a channel 252 communicated with the audio outlet P10. The size of the channel 252 is maintained constant or increased from an end close to the audio outlet to an end far from the audio outlet. By the above-mentioned design, the sound wave produced by the vibration of the eardrum is not blocked by the earpad 250, and the majority of the sound wave is transmitted to and collected by the microphone 130. The earpad 250 is properly and elastically deformed according to the contour of the ear canal of the user, so as to fit into the ear canal and to almost block the external noise. In addition, a microphone signal compensating circuit may be built inside the in-ear headset module 200 of the present embodiment, or electronic devices mutually connected with the in-ear headset module 200, such as mobile phone or Bluetooth communication device, etc., provide a microphone signal compensating software or circuit, so as to solve the problems that the eardrum vibration below 500 Hz may be magnified and the eardrum vibration above 2 KHz may be attenuated. Specifically, the Bluetooth communication unit 240 may have a high pass filter circuit 242, and the cutoff frequency of the high pass filter circuit 242 is greater than or equal to 300 Hz, and the slope of the high pass filter circuit 240 is greater than or equal to 3 dB/octave. The slope of the high pass filter circuit 242 indicates that the power gain of the high pass filter circuit 242 is changed according to frequency, and the variance of the power gain of each octave is greater than or equal to 3 dB.

In the present embodiment, the in-ear headset module 200 further includes a moisture-proof air-permeable element 260 disposed at the audio outlet P12. The moisture-proof air-permeable element 260 may also prevent foreign objects from entering the inside of the housing 210. In addition, the microphone 130 has a moisture-proof air-permeable element 134 disposed at an audio inlet 132 of the microphone 130. Both the moisture-proof air-permeable element 260 and the moisture-proof air-permeable element 134 are water-proof air-permeable film, or screen fabric after moisture proof treatment, or other appropriate moisture-proof air-permeable elements.

Figure 3A:
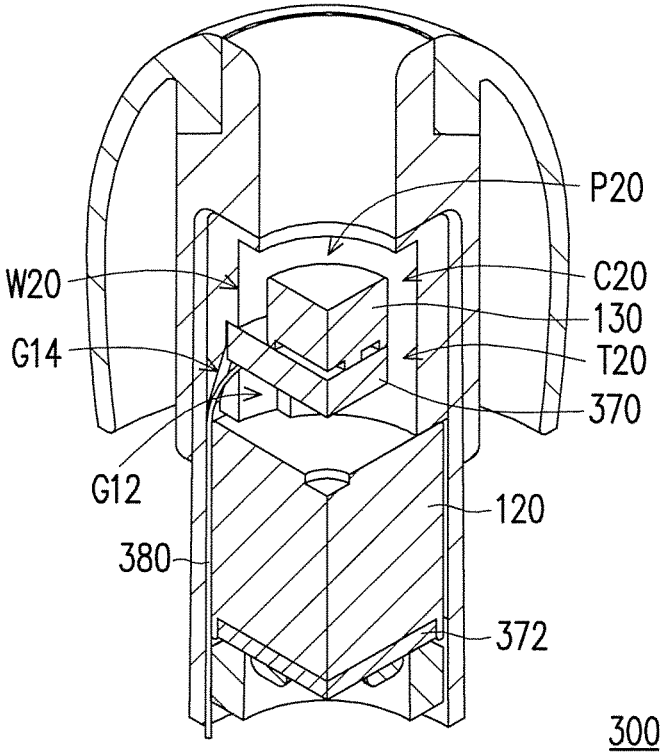
FIG. 3A is a partial cross-sectional view of an in-ear headset module according to another embodiment of the invention.
Figure 3B:
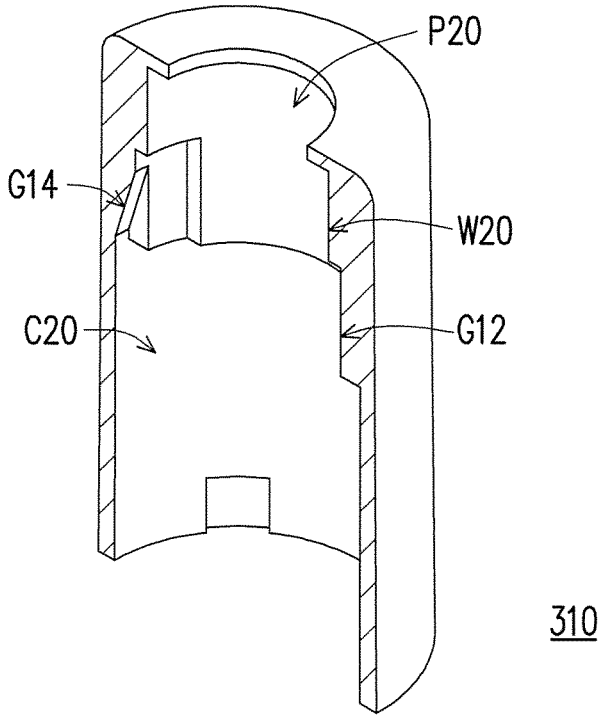
FIG. 3B is a partial cross-sectional view of a housing of the in-ear headset module in FIG. 3A.

FIG. 3A is a partial cross-sectional view of an in-ear headset module according to another embodiment of the invention, FIG. 3B is a partial cross-sectional view of a housing of the in-ear headset module in FIG. 3A. Referring to FIGS. 3A and 3B, the in-ear headset module 300 of the present embodiment is similar to the in-ear headset module 200 in FIG. 2, only the differences between two modules are introduced herein. The in-ear headset module 300 of the present embodiment further includes a printed circuit board 370. The microphone 130 is soldered on the printed circuit board 370 by using surface mount technology (SMT), for example. The printed circuit board 370 is engaged in the chamber C20 of the housing 310. For example, a slot G12 is formed on the wall W20 of the chamber C20, and the protrusion on the outer side of the printed circuit board 370 is exactly engaged into the slot G12. In order to assemble conveniently, one side close to the audio outlet P20 of the slot G12 is designed to be enclosed and another end of the slot G12 is designed to be open. As a result, the printed circuit board 370 is slid into the slot G12 from the open end of the slot G12 and stopped at the enclosed end of the slot G12. In addition, via adjusting the distance between the enclosed end of the slot G12 and the audio outlet P20, the distance value between the microphone 130 and the audio outlet P20 is controlled to be the ideal designed value. A channel T20 is formed between the printed circuit board 370 and the wall W20 of the chamber C20 and configured to transmit sound provided from the speaker unit 120 through the channel 120 to outside the audio outlet P20. Moreover, the shape and the size of the cross section of the channel T20 is changed to adjust the sound quality emitted from the speaker unit 120. Otherwise, the in-ear headset module 300 further includes a microphone lead wire 380. A wire slot G14 is formed on the wall W20 of the chamber C20. The microphone lead wire 380 electrically connects with the microphone 130 and extends through the wire slot G14 to outside, so as to transmit signals and receive electric power. In other embodiments, the microphone lead wire 380 may also connect to another printed circuit board 372, and a lead wire is extended from the printed circuit board 372 and extended to outside. Wherein the speaker unit 120 is disposed on the printed circuit board 372.

In summary, the microphone is located between the audio outlet and the speaker unit in the in-ear headset module of the invention. Therefore, when the in-ear headset module of the invention is wore on the ear of the user, the microphone is located between the speaker unit and the eardrum, both the speaker unit and the microphone isolate the noise of the environment so as to achieve a better sound receiving effect and to save the cost needed if the active noise-cancelling method is used.

Although the invention has been disclosed with reference to the aforesaid embodiments, they are not intended to limit the invention. It will be apparent to one of ordinary skill in the art that modifications and variations to the described embodiments may be made without departing from the spirit and the scope of the invention. Accordingly, the scope of the invention will be defined by the attached claims and not by the above detailed descriptions.

What is claimed is:

1. An in-ear headset module, comprising:

a housing, having a chamber and an audio outlet communicated with the chamber;

an earpad, disposed outside the housing;

a speaker unit, disposed in the chamber; and a microphone, disposed in the chamber and located between the audio outlet and the speaker unit, wherein a diameter of the microphone is smaller than or equal to 6 mm, and a contact between the speaker unit and the chamber is an airtight contact.

2. The in-ear headset module as recited in claim 1, wherein the speaker unit separates the chamber into a front chamber and a rear chamber and prevents air from flowing between the front chamber and the rear chamber, and the microphone is located in the front chamber.

3. The in-ear headset module as recited in claim 1, further comprising a moisture-proof air-permeable element disposed at the audio outlet.

4. The in-ear headset module as recited in claim 1, wherein a moisture-proof air-permeable element is disposed at an audio inlet of the microphone.

5. The in-ear headset module as recited in claim 1, wherein the earpad is disposed outside the audio outlet of the housing and forms a channel communicated with the audio outlet, a size of the channel is maintained constant or increased from an end close to the audio outlet to an end far from the audio outlet.

6. The in-ear headset module as recited in claim 1, wherein a diameter of the speaker unit is smaller than or equal to 6 mm.

7. The in-ear headset module as recited in claim 1, wherein the microphone is a condenser microphone.

8. The in-ear headset module as recited in claim 1, wherein a channel is formed between the microphone and a wall of the chamber and configured to transmit sound provided from the speaker unit through the channel to outside the audio outlet.

9. The in-ear headset module as recited in claim 1, further comprising a Bluetooth communication unit electrically connecting to the speaker unit and the microphone, wherein the Bluetooth communication unit has an echo cancelling circuit.

10. The in-ear headset module as recited in claim 1, further comprising a Bluetooth communication unit electrically connecting to the speaker unit and the microphone, wherein the Bluetooth communication unit has a microphone high pass filter circuit, and a cutoff frequency of the microphone high pass filter circuit is greater than or equal to 300 Hz.

11. The in-ear headset module as recited in claim 1, further comprising a Bluetooth communication unit electrically connecting to the speaker unit and the microphone, wherein the Bluetooth communication unit has a microphone high pass filter circuit, and a slope of the microphone high pass filter circuit is greater than or equal to 3 dB/octave.

12. The in-ear headset module as recited in claim 1, wherein the housing is integrally formed, and a maximum outer diameter of the housing is smaller than or equal to 8 mm.

13. The in-ear headset module as recited in claim 1, wherein an audio inlet of the microphone is directly opposite the audio outlet.

14. The in-ear headset module as recited in claim 1, further comprising a printed circuit board, wherein the printed circuit board is engaged in the chamber, the microphone is soldered on the printed circuit board, and a channel is formed between the printed circuit board and a wall of the chamber and configured to transmit sound provided from the speaker unit through the channel to outside the audio outlet.

15. The in-ear headset module as recited in claim 1, further comprising a microphone lead wire, wherein a wire slot is formed on a wall of the chamber, the microphone lead wire electrically connects with the microphone and extends through the wire slot to outside.

* * * * *